United States Patent [19]

Detterbeck

[11] 3,944,786

[45] Mar. 16, 1976

[54] COOKING TRAY WITH CONTROL INDICATOR MEANS

[75] Inventor: Heinrich Detterbeck, Traunreut, Germany

[73] Assignee: Siemens Electrogerate GmbH, Berlin and Munich, Germany

[22] Filed: Sept. 24, 1974

[21] Appl. No.: 508,861

Related U.S. Application Data

[62] Division of Ser. No. 246,243, April 21, 1972, Pat. No. 3,838,249.

[52] U.S. Cl. ..... 219/453; 219/460; 219/448; 219/464; 219/487; 116/133; 340/417

[51] Int. Cl.[2] ..... H05B 3/68

[58] Field of Search ..... 219/445, 448, 449, 453, 219/455, 457, 458, 459, 460, 461, 462, 463, 464, 465, 466, 467, 487, 506; 338/196; 116/133; 340/417

[56] References Cited

UNITED STATES PATENTS

| | | | |
|---|---|---|---|
| 2,136,763 | 11/1938 | Smith | 219/459 |
| 2,180,602 | 11/1939 | Morgan | 219/457 X |
| 3,345,498 | 10/1967 | Siegla | 219/464 |
| 3,348,025 | 10/1967 | Bassett, Jr. et al. | 219/467 |
| 3,370,260 | 2/1968 | Hardison et al. | 338/196 |
| 3,430,232 | 2/1969 | Martin | 340/417 |
| 3,612,826 | 10/1971 | Deaton | 219/453 |
| 3,641,968 | 2/1972 | Grayson | 219/487 X |

FOREIGN PATENTS OR APPLICATIONS

| | | | |
|---|---|---|---|
| 89,325 | 5/1957 | Norway | 219/464 |
| 221,200 | 5/1962 | Austria | 219/461 |

*Primary Examiner*—Volodymyr Y. Mayewsky
*Attorney, Agent, or Firm*—Kenyon & Kenyon Reilly Carr & Chapin

[57] ABSTRACT

A cooking tray is disclosed in which a carrier of tempered glass is mounted on a support surface between the support surface and the heating element. The carrier is insulated to protect it from the heat of the heating element by thermal sealing means comprising in one embodiment an intermediate ring surrounding the heating element having a layer of insulation attached to the intermediate ring. Moisture seals are also provided between the carrier and the heating element to prevent moisture from entering between the carrier and the heating element.

Various alternative embodiments illustrating the concept of utilizing the carrier of tempered glass with an intermediate ring, heat insulation and moisture sealing means to permit the combination of various heating elements with a carrier of tempered glass are disclosed.

7 Claims, 15 Drawing Figures

COOKING TRAY WITH CONTROL INDICATOR MEANS

This is a division of application Ser. No. 246,243 filed Apr. 21, 1972, now U.S. Pat. No. 3,838,249.

BACKGROUND OF THE INVENTION

1. Field of the Invention

The invention is concerned with a cooking tray. More particularly with the carrier for a cooking tray in which there is at least one opening through the carrier for a heating element with a sealing ring disposed between the carrier and the heating element and a clamping means located on the bottom side of the carrier, by which the heating element is held in the opening.

2. Description of the Prior Art

In conventional cooking trays of this type where the heating elements have a solid metal casing (cooking plates or hot plates), the heating elements are clamped in openings the same size as the elements cut in a sheet metal carrier. This procedure is employed in order to save material by using the thinnest possible gauge and yet obtain a cooking tray of sufficient mechanical stability. Previously, it has been necessary to press ribs into the carrier and, in addition, to use supportive clamping devices which could be rather complicated and covered the entire length of the cooking tray. Apart from the material and manufacturing costs required, the uneven surface formed by the embossing in the carrier is more difficult to keep clean, and thereby causes difficulty, particularly when steel is used. In addition to the uneven shape, because of the high heat conductivity of metal, the carrier reaches very high temperatures in the area adjacent to the heating plate and dirt easily forms and cakes there.

A further disadvantage of previously known designs is the impracticality of matching the color of the outer surface of the carrier to the surroundings. This drawback is more important, the more one endeavors to offer electrical home appliances in as many colors and designs as possible.

It is therefore an object of the invention to develop a cooking tray, the decorative design of which can be changed by simple means and at low cost.

It is a further object to design a tray having low maintenance and a weight comparable to that of conventional cooking trays made from alloy steel.

SUMMARY OF THE INVENTION

The solution to the problems of the prior art is accomplished in accordance with this invention by using a flat carrier plate of tempered glass as the carrier in the cooking tray.

An essential advantage of the invention is that the thickness of the plate-shaped carrier can be chosen so that additional reinforcement and clamping arrangements are not required and sufficient mechanical stability can be attained at low manufacturing costs with the total weight of the tray lower than in previously known designs. As an example, for a cooking tray of usual dimensions with four cooking elements, a carrier having a thickness of only 5 mm is sufficient. Because a substructure (clamping device) is required only under the heating elements, cutouts in the work surface carrying the cooking tray can be limited to the relatively small area of this substructure, regardless of the shape and size of the remainder of the cooking tray, which can therefore be chosen without restrictions.

In the carrier constructed in accordance with the invention, special surface treatment is eliminated, because tempered glass has a very dense and extremely resistant surface which is very easy to take care of. Additionally, because of the poor thermal conductivity of glass, the baking of dirt onto the surface is eliminated.

BRIEF DESCRIPTION OF THE DRAWINGS

Further details and advantages of the invention will be explained with the aid of the embodiments shown in the Figures of which.

DESCRIPTION OF THE PREFERRED EMBODIMENT

Figure 1:
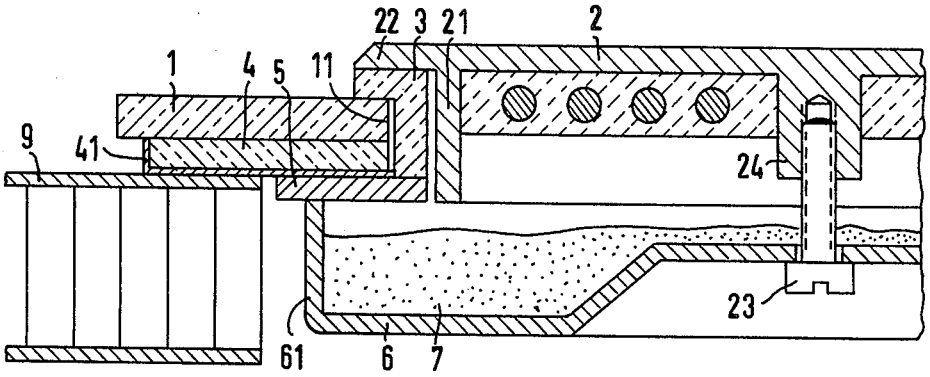
FIG. 1 illustrates a cross-sectional view of a cooking tray in which a cooking plate is the heating element.

As shown in the Figures, particularly FIG. 1, a carrier plate of tempered glass 1, for example, has at least one circular opening with a lateral edge 11, for a so-called solid cooking plate 2. Between the carrier 1 and the work surface 9 a layer of insulating material 4 is disposed at the bottom side of the carrier. By way of example, this layer 4 may be of asbestos having a lining of stainless steel sheet 41 at least at its outer edges.

The cooking plate 2 has an overhanging flange 22 and a rim 21 extending vertically downward. Inserted between both the rim 21 and flange 22 and the carrier 1 is a sealing ring 3 of L-shaped cross-section and made from temperature resistant material having low thermal conductivity such as asbestos. This seal, at least at the outer edge, may have a lining of stainless steel sheet.

For fastening the cooking plate 2 in the opening of the carrier 1 a shallow tray 6 is appropriately made from sheet steel or metal and can be partially filled with a heat insulating material 7. The tray is clamped against the bottom side of the carrier 1 by means of a screw 23 which can be screwed into a central portion 24 of the cooking plate 2. When the rims 61 are bent upward, it rests either directly on the insulation layer 4 or, as shown, on an interposed pressure plate 5. The depth of the tray 6 is designed so that is does not protrude beyond the lower edge of the work surface 9, which in most cases is 30 mm thick, if the cooking tray is inserted into a corresponding cutout of the work surface.

Cooking trays manufactured according to the invention are preferably made with two cooking plates in tandem or with a hot plate, and the combination of these basic elements is held together by means of a frame corresponding to the selection of the basic elements.

Figure 2:
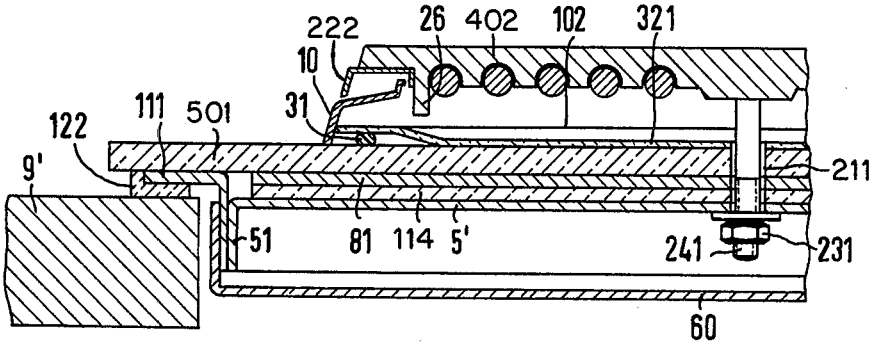
FIG. 2 illustrates a cross-sectional view similar to FIG. 1 through a second embodiment of the invention.

An improved design, in which the cost to manufacture such a cooking tray is reduced, will be explained with the aid of FIG. 2. Here, the carrier plate 501 extends beneath the heating plate 402, and the size of the opening 211 is selected to be only sufficient to accommodate a clamping stud or heat sensor of the heating plate. Not only are the costs for the tools to make the openings thereby reduced, but better overall stability also results, thereby making it possible to use carrier plates with less material thickness.

The cooking tray 402 is arranged in the cutout of the work surface 9' so that its carrier plate 501 of tempered and/or pre-stressed glass rests against the top side of the work surface 9' through a seal 122. In FIG. 2 on the top side of the carrier plate 501 a solid cooking plate 402 is arranged, equipped with a centrally located clamping stud 241. The plate 402 with a skirt 222 rests on an intermediate ring 10 which serves to thermally decouple the plate from the carrier. The cooking plate 402 is designed with a relatively low circular web 26, so that a low design results. Even more favorable configurations can be obtained by means of cooking plates of sheet metal such as steel.

On the top side of the carrier plate 501, under the cooking plate 402, a protective layer made up of two parts is arranged to permit thermal decoupling. This protective layer consists of a layer 321 of thermal insulating material and a covering 102 made in the shape of a lid, arranged on top of it, the surface of which facing the cooking plate is designed to be as reflective of radiant heat as possible. In another modification of this design, the top side of the layer 321 can itself be made as the layer which reflects the radiant heat.

In order to seal the area under the cooking plate against the entry of moisture, a silicone seal 31 is provided, and arranged between the carrier plate 1 and the layer 321 where it is protected against excessive heat effects.

In the design of cooking trays of the type described, it has been observed that in the area where the heating plate rests on the carrier due to the poor heat conductivity of the carrier, a steep temperature gradient causes considerable mechanical stresses, and must be taken into consideration in the design of the cooking tray. According to a further embodiment of the invention, these temperature gradients can be reduced by arranging an intermediate layer 81 (FIG. 2) of material with high heat conductivity (for example, soft aluminum) in good thermal contact with the carrier between the carrier 501 and the layer of insulating material, such as asbestos. Depending on the thickness and heat conductivity of the intermediate layer and the heat transfer resistance from the carrier to the intermediate layer, the temperature gradient mentioned above can be reduced to a greater or lesser degree. Adequate practical results can be obtained with a soft aluminum carrier of 1 mm thickness which is pressed against the bottom side of the carrier 1 by means of the pressure plate 5' , which forms part of the clamping device. Thus, carrier plates of small thickness can be used.

An opening 211, the same size as the diameter of clamping stud 241 mounted to the cooking plate 402, passes through carrier plate 501 and the layers disposed above and below it. By tightening a nut 231 on the clamping stud 241, the entire arrangement can be held together by clamping the cooking tray underneath and fastening it laterally at the downwardly bent leg 51 of pressure plate 5'. Additionally, the entire substructure rests against the work surface 9' through angle 111 and gasket 122.

With reference to FIGS. 3 to 11, these Figures illustrate different embodiments of the intermediate ring designed for better thermal decoupling between the cooking plate and the carrier. It can consist of metal, heat insulating materials such as pressed glass, ceramic or asbestos coated on the outside, as well as combinations of these materials. Particularly in the case of a flat cooking plate, it can also be designed in the shape of a cup, and may also cover the bottom side of the cooking plate.

Figure 3:
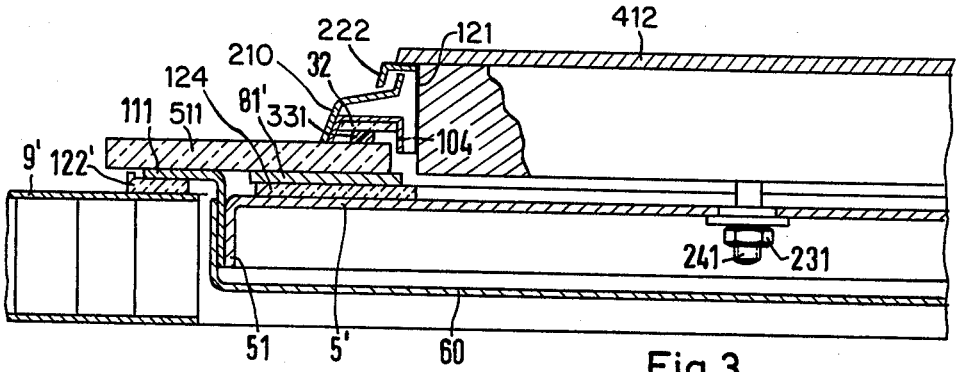
FIG. 3 illustrates a cross-sectional view similar to FIG. 2 through a third embodiment of the invention.
Figure 4:
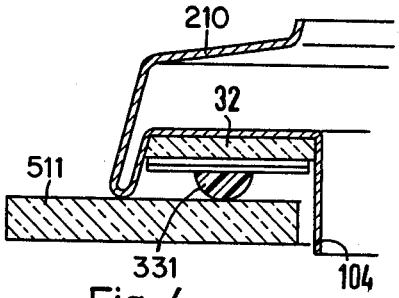
FIGS. 4 to 7 illustrate various cross-sectional designs for an intermediate ring utilized in the invention.

According to FIG. 3 and the enlarged illustration shown in FIG. 4, the intermediate ring of metal 210 rests on the carrier 511 through a layer of asbestos 32 and a seal of silicone 331. For protection, the seal 331 is arranged at a distance from the edges of the intermediate ring 210, which becomes very hot during operation. The essentially flat pressure plate 5' extends beneath the cooking plate 412, has downward pointing legs 51 and serves to fasten the cooking plate 412 by threaded stud 241 and a lock nut 231.

Figure 5:
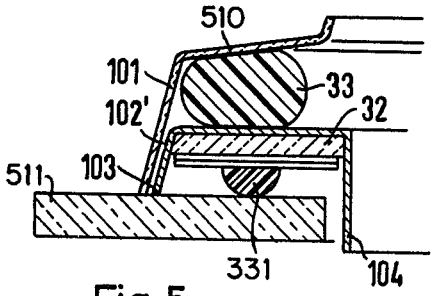

In the design shown in FIG. 5, the intermediate ring 510 consists of two ring-shaped members 101 and 102' arranged at a small lateral distance from each other made, for example, of asbestos. The selection of the distance between the two members is determined by projections 103 pressed out of the inner ring 102'. Between the two ring-shaped members 101 and 102' a seal 33 is located.

Figure 6:
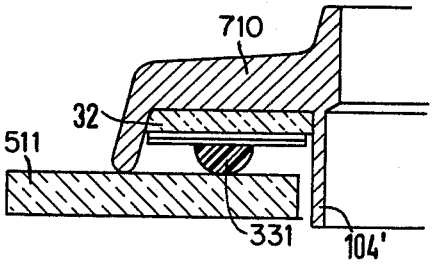

In the embodiment shown in FIG. 6, the intermediate ring 710 is a thin-walled die casting of aluminum, for example.

Figure 7:
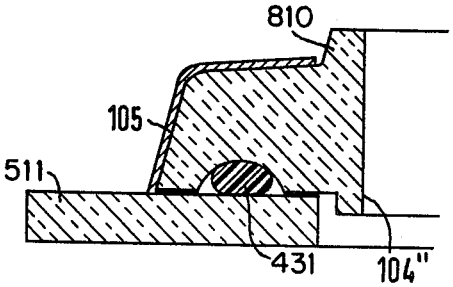

As shown in FIG. 7, the intermediate ring 810 is formed as a molded part of poor heat conducting material, for example, asbestos, steatite, porcelain or temperature resistant glass. Because such materials are adapted to insulate against the very large temperature difference thay may develop in such materials between the contact surface of the cooking plate on the intermediate ring and the contact surface of the intermediate ring on the carrier 511, the layer 32, shown in the embodiments of FIGS. 3 to 6, can be omitted. If an intermediate ring of steatite or porcelain is used, the material should be glazed on the outside surface; if molded asbestos is used, it is recommended to cover the outside with a lining 105, for example, of sheet steel.

In all the embodiments illustrated in FIGS. 3 to 7, the intermediate ring also serves for centering the cooking plate in the carrier 511, and for this purpose has a collar 104 and 104' protruding into the opening of the carrier 511.

The intermediate ring should be designed so that it absorbs the largest possible portion of the temperature difference between the heating plate and the carrier plate, without detracting from the pleasing appearance of the cooking tray. A particularly favorable design of this type can be achieved by selecting the radial distance between the outer contact point of the intermediate ring and the heating plate, and the inner contact point of the intermediate ring and the carrier plate to be at least 1.5 times as large as the projection of that part of the intermediate ring which lies above the carrier plate on a plane extending perpendicular to the carrier plate.

Examples of embodiments of this type are shown in FIGS. 8 to 11.

Figure 8:
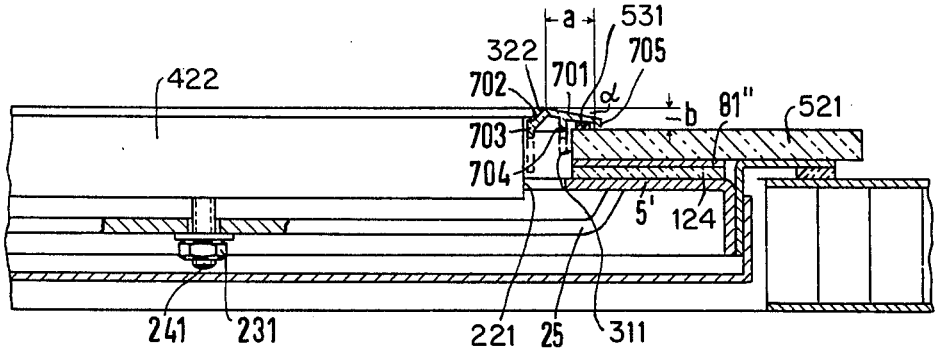
FIG. 8 illustrates a cross-sectional view similar to FIG. 3 through a fourth embodiment of the invention.

As shown in FIG. 8, the cooking plate 422 rests against the carrier plate 521 through an intermediate ring 701 of pressed glass and is held by threaded stud 241, nut 231 and strap 25 in the opening 311 of the carrier plate 521 with the strap 25 bearing against the pressure plate 5'.

The intermediate ring 701 has a side 702 which runs at an angle outward, and fits a correspondingly shaped side at the edge of the cooking plate 422. Inserted between these two sides is a heat resistant sealing means 322 which also serves to maintain the material-tight connection between the cooking plate 422 and the intermediate ring 701. The shape of the cooking plate 422 and the intermediate ring 701 is chosen so that a continuous transition from the plane of the cooking plate to the intermediate ring is obtained. The intermediate ring in turn is inclined at an angle $\alpha$ of less than 20°. The radial distance of the intermediate ring *a* between the contact points closest to each other at the heating plate 422 and the carrier plate, respectively, is about three times that of the projection *b* of that part of the intermediate ring which lies above the carrier plate 521 on a plane extending perpendicular to the carrier plate 521. The intermediate ring 701 rests on the carrier plate 521 only at leg 705 at its outermost end and extends over seal 521. The intermediate ring 701 further has legs 703 and 704 protruding into the opening, which serve the purpose of thermal shielding and may, as shown by dashed lines, extend over the entire thickness of the carrier plate 521.

Figure 9:
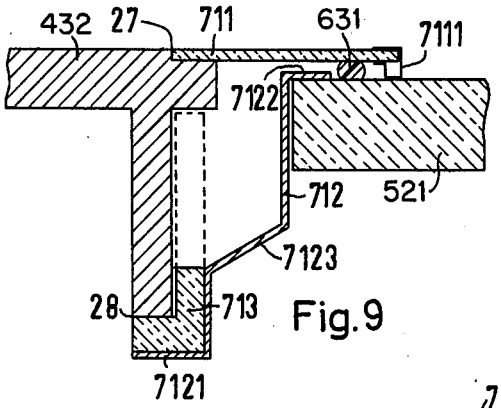
FIGS. 9 to 11 illustrate in cross-sectional view further designs for an intermediate ring.

Further improved thermal decoupling than in the embodiment shown in FIG. 8 is obtained with the design shown in FIG. 9 in which the intermediate ring consists of a support ring 712 and an auxiliary ring 713 which preferably consists of asbestos, and is arranged between a lower edge 28 of the cooking plate 432 and an arm 7121 of the support ring 712 which consists preferably of metal. The support ring and the auxiliary ring can be bonded tightly to each other. The support ring 712 rests on the top side of the carrier plate 1 only at the flat flange 7122; an offset intermediate piece 7123 provides substantial thermal decoupling. If desired, the space between the support ring 712 and the cooking plate 432 can be entirely or partially filled with heat insulating material, as indicated by the dashed lines. A cover ring 711 serves to cover the support ring and the auxiliary ring, extends through member 7111 over the flange 7122 as well as over the seal 631, and is connected to the cooking plate 432 in a moisture proof manner at 27. The sole governing factor for the selection of the material and the shape of the cover ring is the requirement of optimum thermal decoupling, as this cover ring need not support any forces.

Figure 10:
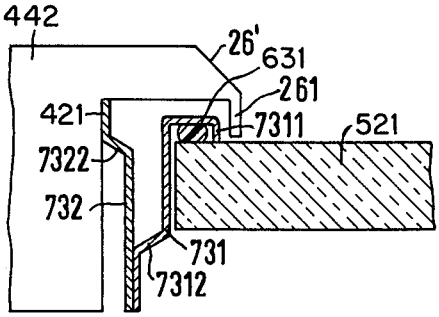

In the design shown in FIG. 10, a support ring 731 and an auxiliary ring 732 is again provided, the function of the cover ring being supplied by a suitably shaped rim area 261 of the cooking plate 442. This rim area is extended by member 261 over the flange 7311 of the support ring 731 and the seal 631, without fully touching the carrier plate 521. The carrier ring 731 and auxiliary ring 732 each have an offset portion 7312 and 7322, respectively, and are connected with each other, for instance, by welding. In the interest of optimum thermal decoupling, the support ring and/or auxiliary ring may be perforated, the amount and type of which is limited only by the requirement that it have adequate mechanical stability.

Figure 11:
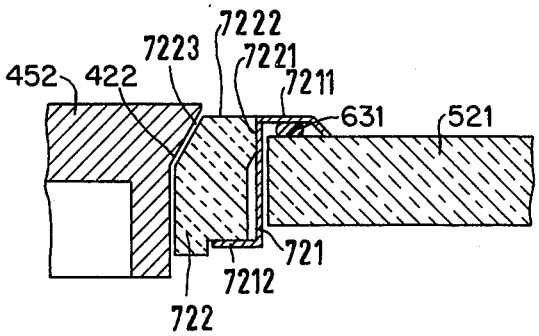

FIG. 11 shows a further embodiment, similar to the design shown in FIG. 8, in which the connection between the cooking plate 425 and the intermediate ring is through inclined, outward sloping surfaces 422 and 7223, respectively. However, the intermediate ring here consists of a support ring of metal 721 which, with flange 7211, extends over a seal 631 on the top side of the carrier 521, into the opening, and through arm 7212 supports auxiliary ring 722. This ring 722 is tightly connected, for instance, by soldering, with the support ring 721 at 7221 and is made from thermal insulating material, such as asbestos cement, and may be coated on the top side 7222.

In the embodiments described so far a heating plate, held by a clamping device located below the carrier, served as the heating element.

Figure 12:
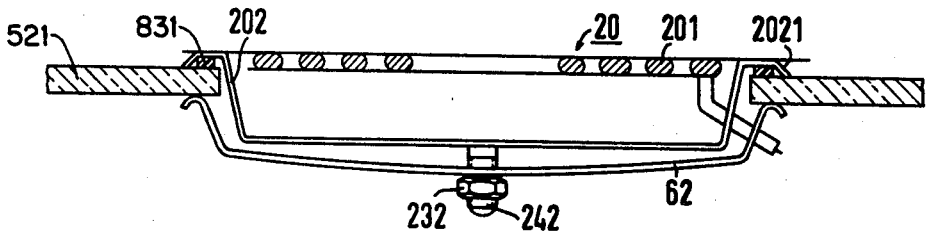
FIG. 12 illustrates in cross-sectional view an embodiment using a radiation heater.

According to FIG. 12, a heating element 20 is fastened in the opening of the carrier 521 of tempered glass by means of a threaded stud 242, a nut 232 and a clamping device 62. The heating element 20 is designed as a radiant electrical unit 201 arranged and mounted in a support tray 202. This support tray has a bent-over edge 2021, covering a seal 831 by which the support tray rests on the carrier 521. The dimensions of the seal 831 are such that when in the mounted position as shown, it is in tension between the carrier 521 and the edge 2021. The radiant heater unit 201 consists of a known tubular heating unit shaped into a spiral.

Figure 13:
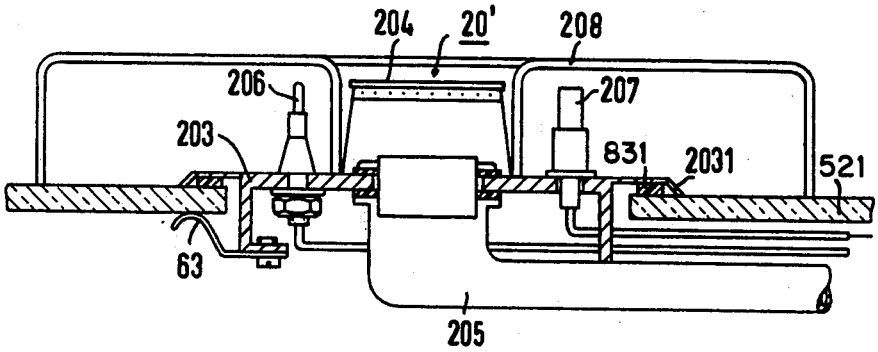
FIG. 13 illustrates in cross-sectional view an embodiment using a gas burner.

In the design according to FIG. 13, a heating element 201 is fastened in the opening of the carrier 521 by means of a clamping device 63. The heating element consists of a support element 203 to which a gas burner 204, a lighter 207, a safety sensor and a support grating 208 as well as a gas line 205 are fastened. The support element 203 also has a rim 2031 which is bent down, braced against the carrier 521 and extends over a seal 831, the dimensions of which are in accordance with the description of the seal 831 shown in FIG. 12.

As shown by all of the embodiments described, little or no heat conduction occurs between the hottest parts of the heating elements and the parts resting on the carrier, and no additional steps to reduce the heat transfer from the heating element to the carrier are necessary.

It is also a goal of the improvement exemplified by the invention to combine an operating indicator for the heating elements of the cooking tray which is as simple and easy to read as possible as well as using as many heating elements for a stove (oven) with a cooking tray of glass.

This further improvement is characterized by providing each heating element with an identification carrier coupled with the control element associated with the heating element, or with its operating control, respectively, and by arranging this identification carrier below the carrier in such a manner that it can be read through the carrier. It is particularly advantageous to cover the lower side of the carrier with opaque material and to provide windows in the mask through which only one part of each identification carrier is visible to a person standing in front of the cooking tray. The side of the mask that is in contact with the carrier can easily be given a design which matches the color and decor of the kitchen furniture surrounding the cooking tray. If solid cooking plates are used as heating elements, it is particularly advantageous to make the mask of material of high heat conductivity, for instance, of aluminum, and to keep this mask in good, heat conducting contact with the carrier; the mask then provides good temperature distribution over the entire carrier, so that thermal stresses resulting from excessive heat gradients are kept within tolerable limits.

Usually, several heating elements will be arranged on one carrier; the operating controls and identification carriers associated with the corresponding control elements are then advantageously arranged in a row below the front edge of the cooking tray, accessible from the front. The identification carriers can be designed as discs, drums or cylinders and consist preferably of transparent material. A lamp arranged behind the identification carriers, which is switched on when one heating element is put in operation, provides for a further improvement in the quantitative indication of operation. Advantageously, this light source simultaneously illuminates a strip of transparent material arranged at the front side of the cooking tray and in a plane perpendicular to the carrier of the cooking tray. It can therefore also be distinctly recognized by a person situated at a greater distance from the cooking tray (qualitative indication of operation).

Two examples of embodiments of this kind will be explained with the aid of FIGS. 14 and 15.

Figure 14:
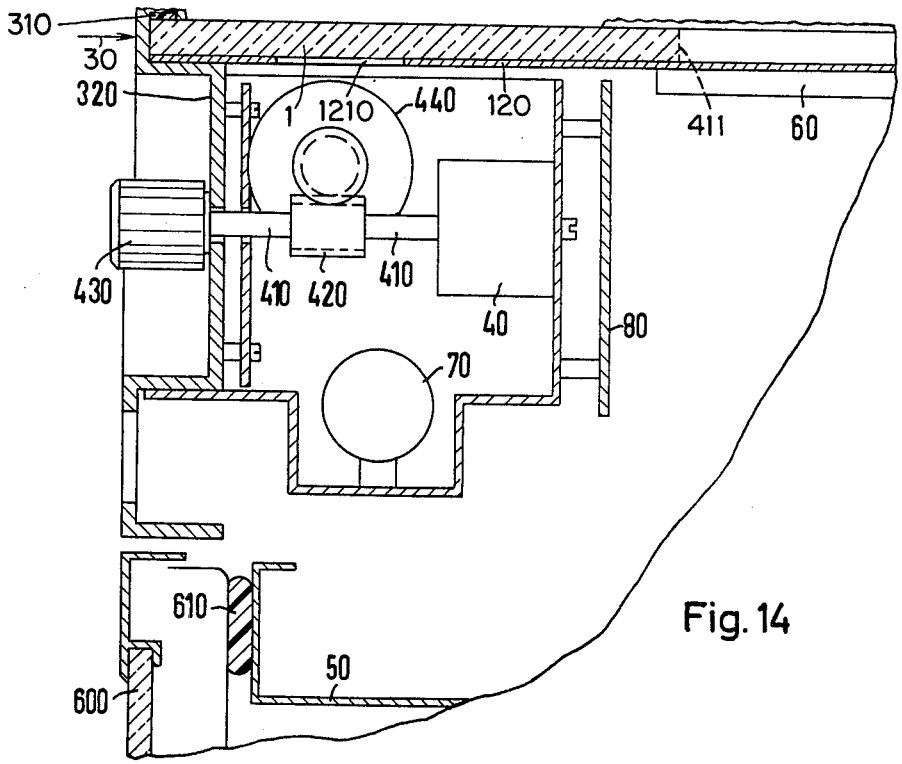
FIGS. 14 to 15 illustrate in a partial and cross-sectional view an embodiment in which an indication of the switch position is visible through the carrier plate.

FIG. 14 shows a carrier 531 of tempered glass, built into an electric stove of which only a section is shown. A solid cooking plate 462 is mounted in an opening 411 of the carrier 531. The substructure, particularly the clamping means for the solid cooking plate, is covered up by a shielding tray 60.

On the front side of the stove, the carrier 1 is supported in molding 30 which extends over the front edge of the carrier and encloses a seal 310. The molding has a recess 320 into which the operating controls 430 of the individual control elements 40 (arranged side by side, and either switches or regulators) are accommodated. Each operating control 430 is coupled with the associated control element 40 through shaft 410, which also carries a worm 420. The latter engages through a work wheel attached to a cylinder identification carrier 440, which is rotatably supported on an axis perpendicular to the plane of the drawing and has on its outer surface markings corresponding to the individual positions of the control element 40. These markings are visible through a window 1210 in a mask 120 of opaque, but highly heat conducting material (soft aluminum), which is placed underneath the carrier 531. The markings can additionally be illuminated by means of a light source 70, which is switched on when one of the functions of the stove is put in operation by one of the operating controls 430.

A reflector 80 arranged on the rear side of the control element 40 protects the control elements and identification carriers from excessive heat.

Below the molding 30 of the stove the upper boundary of a muffle 50 and the door 600 are shown. The door serves to close off the muffle, as well as acting to seal the door with seal 610 arranged between the muffle and the door.

Figure 15:
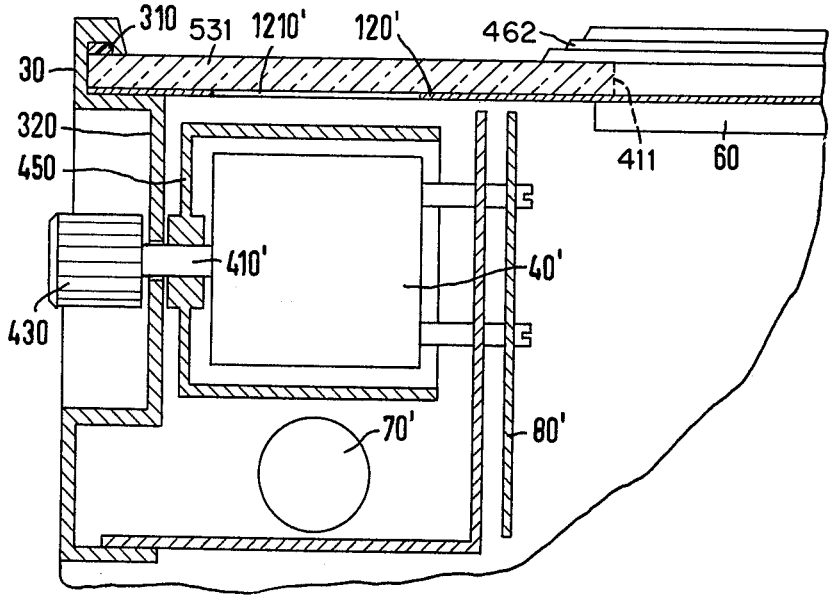

The embodiment shown in FIG. 15 differs from that shown in FIG. 14 merely by the simplified identification carrier 450, which is designed as a hollow drum and is mounted directly on the shaft 410' extending between the operating control 430 and the control element 40'. In the interest of saving as much space as possible, the drum encloses the control element40'.

The idea of the invention has been illustrated by reference to a cooking tray with an opening for a heating element; however, it is obviously also applicable to cooking trays of transparent materia having no opening, in which the heating elements are in contact with the bottom side of the carrier. material In the foregoing, the invention has been described in reference to specific exemplary embodiments. It will be evident, however, that variations and modifications, as well as the substitution of equivalent construction and arrangements for those shown for illustration, may be made without departing from the broader scope and spirit of the invention as set forth in the appended claims. The specification and drawings are accordingly to be regarded in an illustrative rather than in a restrictive sense.

What is claimed is:

1. A cooking tray comprising:

a. a cooking unit having at least one heating unit;

b. a carrier member of tempered glass disposed in spaced relation below said cooking unit, said carrier having at least one opening adapted to permit the connection of the cooking unit to the carrier;

c. a sealing means having low thermal conductivity disposed around the circumference of the heating element and connecting the carrier and the heating to thermally insulate the carrier from the heating element;

d. fastening means mounted on the bottom side of the carrier member and passing through the opening in the member to detachably fasten together member and the cooking unit;

e. a first control element having a first operating control disposed below said carrier and coupled to control said heating element; and f. a first identification carrier coupled to said first operating control and disposed so as to be visable through said carrier to provide an indication of the position of said first control element.

2. A cooking tray in accordance with claim 1 wherein the bottom of the first carrier has an opaque mask having a window to view the identification carriers.

3. A cooking tray in accordance with claim 2 wherein the mask is made from material of high heat conducitivity.

4. A cooking tray in accordance with claim 1 and further including a second heating element, said second heating element having associated therewith a second control element and operating control and further including a second identification carrier coupled to said second control element to provide an indication of the position of said second control element.

5. A cooking tray in accordance with claim 4 wherein the identification carriers are arranged adjacent to each other at an edge portion of the carrier.

6. A cooking tray in accordance with claim 5 wherein the edge portion extends parallel to the front edge of the cooking tray, and the operating controls associated with the control elements are arranged in a row adjacent to each other in a level below the carrier.

7. A cooking tray in accordance with claim 6 wherein the identification carrier is a hollow drum, open on one side, mounted directly on a shaft extending above the control element between the operating control and the control element.

* * * * *

UNITED STATES PATENT AND TRADEMARK OFFICE

CERTIFICATE OF CORRECTION

PATENT NO. : 3 944 786

DATED : March 16, 1976

INVENTOR(S) : Heinrich Detterbeck

It is certified that error appears in the above-identified patent and that said Letters Patent are hereby corrected as shown below:

In Column 5, line 60, change "261" to --26'--.

In Column 6, line 32, change "201" to-20'--.

In Column 7, line 43, change "work" to --worm--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*